US011737520B2

(12) United States Patent
Kim et al.

(10) Patent No.: US 11,737,520 B2
(45) Date of Patent: Aug. 29, 2023

(54) NON-SLIP SHOE CAPABLE OF ABSORBING SHOCK

(71) Applicant: SHINWON CHEMICAL PRODUCTS CO., LTD., Gimhae-si (KR)

(72) Inventors: Sung Sim Kim, Busan (KR); Choon Geun Choi, Busan (KR); Do Kyung Choi, Busan (KR)

(73) Assignee: SHINWON CHEMICAL PRODUCTS CO., LTD., Gimhae-si (KR)

( * ) Notice: Subject to any disclaimer, the term of this patent is extended or adjusted under 35 U.S.C. 154(b) by 0 days.

(21) Appl. No.: 16/463,504

(22) PCT Filed: Jan. 23, 2019

(86) PCT No.: PCT/KR2019/000934
§ 371 (c)(1),
(2) Date: May 23, 2019

(87) PCT Pub. No.: WO2020/153511
PCT Pub. Date: Jul. 30, 2020

(65) Prior Publication Data

US 2021/0353006 A1 Nov. 18, 2021

(51) Int. Cl.
*A43C 15/16* (2006.01)
*A43B 13/18* (2006.01)
(Continued)

(52) U.S. Cl.
CPC ..... *A43C 15/168* (2013.01); *A43B 13/184* (2013.01); *A43B 13/26* (2013.01); *A43C 15/065* (2013.01); *A43C 15/161* (2013.01)

(58) Field of Classification Search
CPC ... A43C 15/168; A43C 15/161; A43C 15/165; A43C 15/065; A43C 15/06;
(Continued)

(56) References Cited

U.S. PATENT DOCUMENTS 3,846,921 A * 11/1974 Kobayashi ..... A43C 15/165 36/59 R
4,159,582 A 7/1979 Ostrowski
(Continued)

*Primary Examiner* — Sharon M Prange
*Assistant Examiner* — Grady Alexander Nunnery
(74) *Attorney, Agent, or Firm* — Kile Park Reed & Houtteman PLLC

(57) ABSTRACT

Provided is a non-skid shoe capable of absorbing shock including: an outsole; a plurality of accommodation grooves formed on the outsole, the accommodation groove including a groove portion, and a penetrated portion extending from the groove portion and penetrating the outsole; a support member which is accommodated in the respective accommodation grooves, and includes a support portion disposed in the groove portion, a first guide portion formed at a center of the support portion, and a second guide portion extending from the first guide portion and penetrating a bottom surface of the support portion; a movable member which is disposed in the respective support members, and includes a latch portion and a protruding portion; a pressing member engaged to an upper portion of the first guide portion; a resilient member disposed in the first guide portion; and a midsole engaged to the top surface of the outsole.

2 Claims, 5 Drawing Sheets

(51) Int. Cl.
*A43B 13/26* (2006.01)
*A43C 15/06* (2006.01)

(58) Field of Classification Search
CPC ... A43C 15/061; A43C 15/063; A43C 15/066; A43C 15/068; A43C 15/08; A43C 15/14
See application file for complete search history.

(56) References Cited

U.S. PATENT DOCUMENTS

| | | | | | |
|---|---|---|---|---|---|
| 4,715,133 | A * | 12/1987 | Hartjes | A43C 15/14 | 36/134 |
| 5,289,647 | A * | 3/1994 | Mercer | A43C 15/14 | 36/134 |
| 2004/0079001 | A1* | 4/2004 | McMullin | A43C 15/161 | 36/134 |
| 2011/0126426 | A1* | 6/2011 | Amark | A43C 15/14 | 36/61 |

* cited by examiner

NON-SLIP SHOE CAPABLE OF ABSORBING SHOCK

TECHNICAL FIELD

The present invention relates to a non-slip shoe capable of absorbing shock, and more particularly, to a shoe including movable members which can automatically protrude from or retrieve into an outsole in a process of transmitting or releasing a load of a wearer when the outsole comes into contact with a ground, thereby stably protecting a wearer's body on ice or icy roads, as well as general roads, and preventing a falling accident on the icy road.

BACKGROUND ART

A side of a road is covered by snow or ice in winter to form an icy road, which causes frequent falling accidents. People are severely injured due to the falling accident on the harder icy road, and, in particular, the falling accident may cause a serious injury to the old and the weak who are insensitive to a motor nerve or a reflex nerve.

In order to solve the above problem, there are methods of wearing shoes with an improved non-slip function on an outsole, or putting on an anti-skid member, such as climbing irons, when taking a step on the icy road. However, the former has a problem in that if snow or a chunk of ice is attached to the outsole during walking, the non-slip function of the outsole is remarkably decreased.

The latter has problems in that it is quite cumbersome to attach or detach the anti-skid member to or from the shoe, and comfortable fit is so low during walking, since the anti-skid member is not integrated with the shoe. One solution is disclosed in U.S. Pat. No. 4,159,582, in which an outsole of a shoe is equipped with spikes.

The patent is constructed in such a way that when a load is applied to the outsole during walking, the spikes built in the outsole protrude from a bottom surface of the outsole, and then get stuck in the ice or snow to prevent the sliding. However, since the patent has a drawback in that the spikes do not protrude from the bottom surface even through a load is applied from stones or paved roads, and shock is directly transmitted to a wearer's sole, it can be used in very restricted area.

DISCLOSURE

Technical Problem

Accordingly, the present invention has been made in view of the above-mentioned problems occurring in the prior art, and an object of the present invention is to provide a non-slip shoe capable of absorbing shock, in which a wearer can protect a wearer's body by stably wearing the shoes on general roads, as well as icy roads, for a long time.

Technical Solution

To accomplish the above-mentioned object, there is provided a non-skid shoe capable of absorbing shock comprising: an outsole having a predetermined thickness; a plurality of accommodation grooves which are provided at an anterior portion and a posterior portion of the outsole, and respectively include a groove portion having a cylindrical structure of a predetermined depth, of which an upper portion is opened toward a top surface of the outsole, and a penetrated portion having an upper end communicating with a center of a bottom surface of the groove portion and a lower end penetrating a bottom surface of the outsole; a support member which is accommodated in the respective accommodation grooves, and includes a support portion having a cylindrical shape of a predetermined height and disposed in the groove portion, a first guide portion formed at a center of the support portion to have a predetermined depth, an upper portion thereof being opened, and a second guide portion communicating with a center of a bottom surface of the first guide portion, a lower end penetrating a bottom surface of a center of the support portion, in which the second guide portion is disposed coaxially with the penetrated portion; a movable member which is disposed in the respective support members, and includes a latch portion latched onto a lower portion of the first guide portion, and a protruding portion having an upper end engaged to a bottom surface of the latch portion, and a lower extended portion penetrating the second guide portion and the penetrated portion in order and exposed through the bottom surface of the outsole; a pressing member which is engaged to an upper portion of the first guide portion to seal the upper portion; a resilient member which is disposed in the first guide portion, of which an upper end comes into contact with a bottom surface of the pressing member, and a lower end comes into contact with a top surface of the latch portion of the movable member; and a midsole of a predetermined thickness which is engaged to the top surface of the outsole so that the pressing member comes into integrally contact with an upper portion of the support member.

In this instance, the groove portion and the penetrated portion of the accommodation groove may be formed to be inclined by a predetermined angle to a normal line of the bottom surface of the outsole in a counterclockwise direction.

An auxiliary support member is interposed between the accommodation groove and the support member; a semi-cylindrical seating groove is formed on a front portion of the accommodation groove; the auxiliary support member has a lateral wall of a semi-cylindrical structure and a bottom plate of a semi-circular plate structure which is provided at a lower portion of the lateral wall; and the auxiliary support member is disposed in the seating groove.

A lower end of the protruding portion of the movable member may be provided with a contact end, and the contact end is formed with a recessed portion at a center.

Advantageous Effects

With the above configuration of the present invention, when the load is transmitted or released from the relationship between the outsole and the ground, the movable member protrudes from the outsole by a predetermined length or retreats inside the outsole by the operation of the resilient member, so that the shoe can absorb the shock which is transmitted to a wearer's knee, waist and head during walking, as well as preventing a falling accident on the icy road.

Furthermore, since the present invention provides the configuration in which the movable member built in the outsole is configured to protrude at a predetermined angle to the normal line of the bottom surface of the outsole, or the auxiliary support member is provided, the shoe can more fully absorb the shock which is transmitted to a human body, and can assure the stable waling for a long time, without being slipped.

MODE FOR INVENTION

Hereinafter, preferred embodiments of the present invention will be explained in detail with reference to the accompanying drawings. In the following description, detailed descriptions of well-known functions or constructions will be omitted since they would obscure the invention in unnecessary detail.

Figure 1:
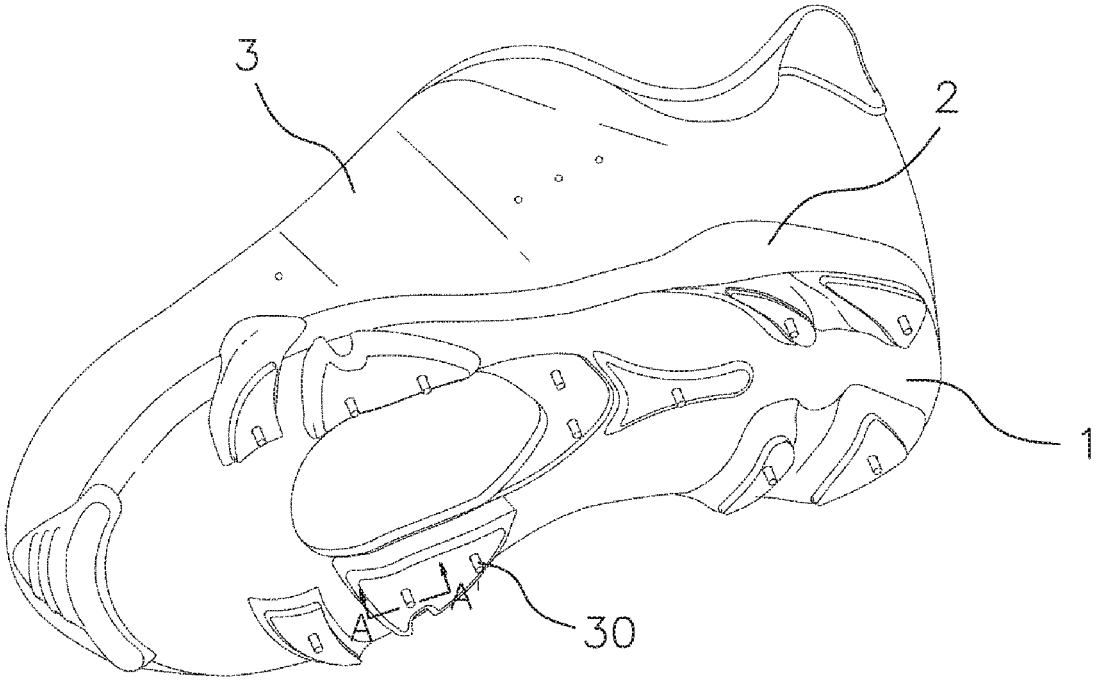
FIG. 1 is a perspective view schematically illustrating a shoe according to the present invention.
Figure 2:
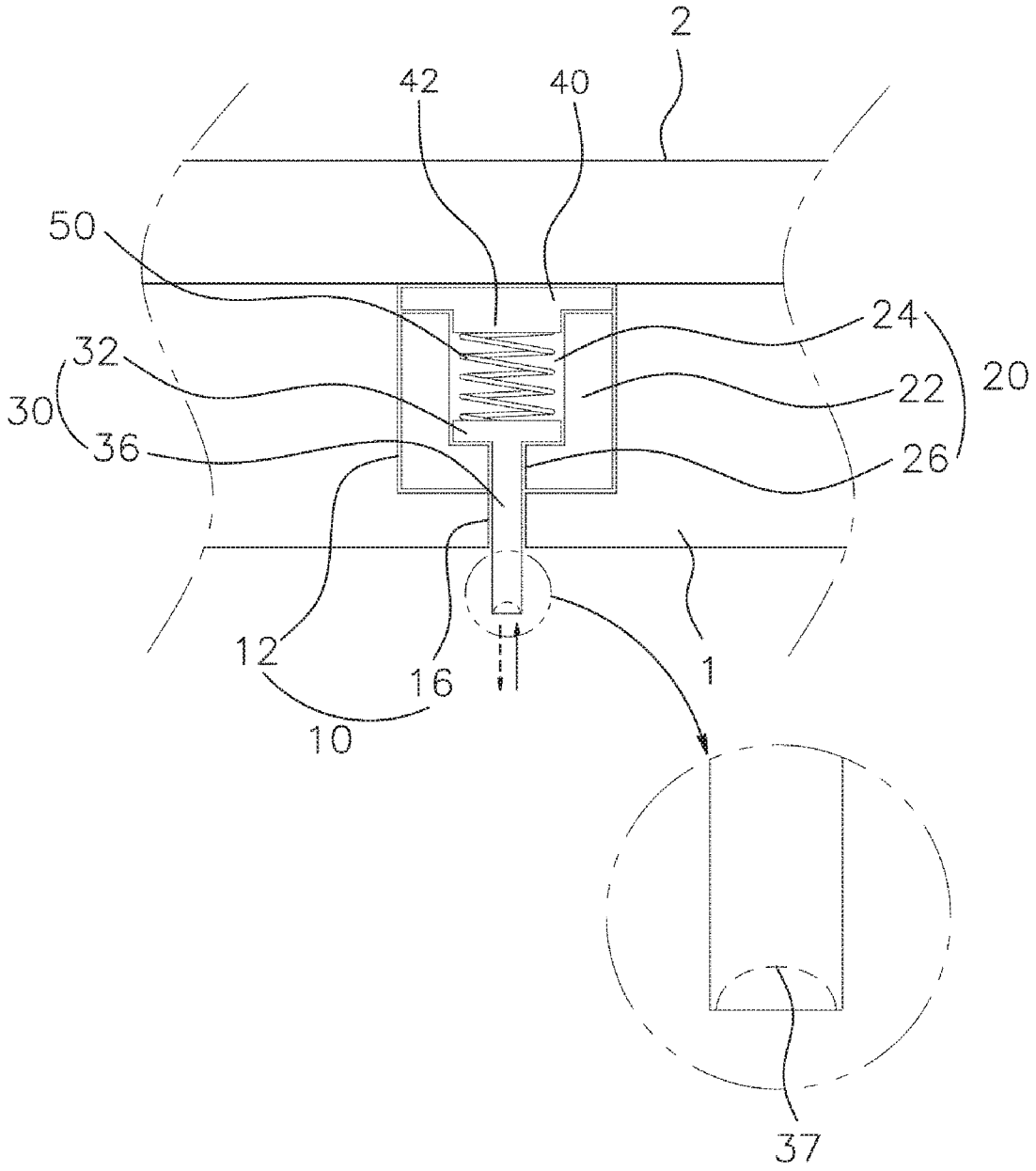
FIG. 2 is a cross-sectional view taken along the line A-A' in FIG. 1 to illustrate the shoe according to one embodiment of the present invention.

FIG. 1 is a perspective view schematically illustrating a non-skid shoe capable of absorbing shock according to the present invention. FIG. 2 is a cross-sectional view taken along the line A-A' in FIG. 1. The non-skid shoe according to one embodiment of the present invention includes, as illustrated in the drawings, an outsole 1, a midsole 2, an accommodation groove 10, a support member 20, a movable member 30, a pressing member 40, and a resilient member 50.

The outsole 1 is a part of the shoe which is in contact with the ground. The outsole has a desired thickness to primarily protect a wearer's foot from external impact. A bottom surface of the outsole 1 may be provided with various tread patterns, as illustrated in FIG. 1.

The accommodation groove 10 is a space for housing the support member 20, and is respectively provided at an anterior portion and a posterior portion of the outsole 1 in a state of being spaced apart from each other at predetermined intervals. Each accommodation groove 10 has a groove portion 12 and a penetrated portion 16.

Each groove portion 12 has a cylindrical structure of a predetermined depth, and an upper portion is opened toward a top surface of the outsole 1. Each penetrated portion 16 communicates with a center of the bottom surface of each groove portion 12 at an upper end thereof, and a lower end of the extended portion penetrates the bottom surface of the outsole 1. In this instance, it is preferable that the penetrated portion 16 has a diameter smaller than that of the groove portion 12.

The support member 20, the movable member 30, the pressing member 40 and the resilient member 50 are accommodated in each accommodation groove 10, and thus components including the support member 20, the movable member 30, the pressing member 40 and the resilient member 50 are provided as many as the number of the accommodation grooves 10. In other words, since the components disposed in each accommodation groove 10 are identical to each other, one accommodation groove 10 selected from the number of accommodation grooves 10 will be described hereinafter, for the purpose of convenient description. In addition, the support member 20, the movable member 30, the pressing member 40 and the resilient member 50 which are disposed in one selected accommodation groove 10 will be described.

The support member 20 is a part for stably supporting and guiding operation of the movable member 30, and has a support portion 22 and first and second guide portions 24 and 26. The support portion 22 has a cylindrical shape and predetermined vertical height corresponding to the shape and height of the groove portion 12 of the accommodation groove 10, and thus is disposed in the groove portion 12.

The first guide portion 24 is formed at a center of the support portion 22 to have a predetermined depth, and an upper portion is opened. An upper end of the second guide portion 26 communicates with the center of the bottom surface of the first guide portion 24, and a lower end penetrates the bottom surface of the center of the support portion 22. In this instance, it is preferably that the first and second guide portions 24 and 26 are respectively disposed coaxially with the penetrated portion 16.

The movable member 30 has a latch portion 32 and a protruding portion 36. The latch portion 32 is latched onto a lower portion of the first guide portion 24. The protruding portion 36 is engaged to a bottom surface of the latch portion 32 at an upper end thereof, and a lower extended portion penetrates the second guide portion 26 and the penetrated portion 16 in order, and then is exposed through the bottom surface of the outside 1. The movable member 30 may consist of the latch portion 32 and the protruding portion 36 which are integrally formed, and preferably is made of metal.

The pressing member 40 is a part for pressing the resilient member 50 while supporting the resilient member 50 against a restoring force, and is engaged to the upper portion of the first guide portion 24 to seal the upper portion. Reference numeral 42 indicates a stepped portion of a predetermined length protruding from the center of the bottom surface of the pressing member 40.

The resilient member 50 is a part for controlling the operation of the movable member 30, of which an upper end comes into contact with the bottom surface of the pressing member 40, and a lower end comes into contact with the top surface of the latch portion 32 of the movable member 30. The resilient member 50 may be a conventional spring made of a metal material.

The midsole 2 has a predetermined thickness, and is engaged to the top surface of the outsole 1. Therefore, the lower portion of the pressing member 40 presses the resilient member 50, and comes into integrally contact with the upper portion of the support member 20. Reference numeral 3 indicates an upper which is engaged to the midsole 2.

With the above the configuration of the present invention, as illustrated in FIG. 2, the lower portion of the protruding portion 36 is maintained in the state of protruding through the bottom surface of the outsole 1 by a predetermined length. When a wearer wearing the shoes walks, the bottom surface of the outsole 1 comes into contact with the ground during walking, and a load of the wearer is transmitted to the outsole 1 via the midsole 2 at that time.

In this instance, since the lower end of the protruding portion 36 comes into contact with the ground, the protruding portion 36 compresses the resilient member 50 by the transmitted load in the state in which the lower end of the protruding portion 36 comes into contact with the ground, so that the resilient member 50 is retracted rearwardly. After that, when the outsole 1 is detached from the ground to release the load transmitted to the outsole 1, the movable member 30 is returned to its original position by the restoring force of the resilient member 50, and then prepares for the next process.

Specifically, since the movable member 30 protruding outwardly from the outsole 1 at a predetermined length compresses the resilient member 50 in the process of transmitting the load, the impact generated when the outsole 1 comes into contact with the ground is appropriately absorbed by the resilient member 50, so that the present invention can protect a knee, a waist and a heat of the wearer from the impact.

In addition, since the lower end of the protruding portion 36 which is exposed through the bottom surface of the outsole 1 at the predetermined length is not fully retracted to the inside of the outsole 1 by the load transmitted during walking, but gets stuck in ice or icy road by a certain length, the present invention can prevent the wearer from being slid during walking.

Figure 5:
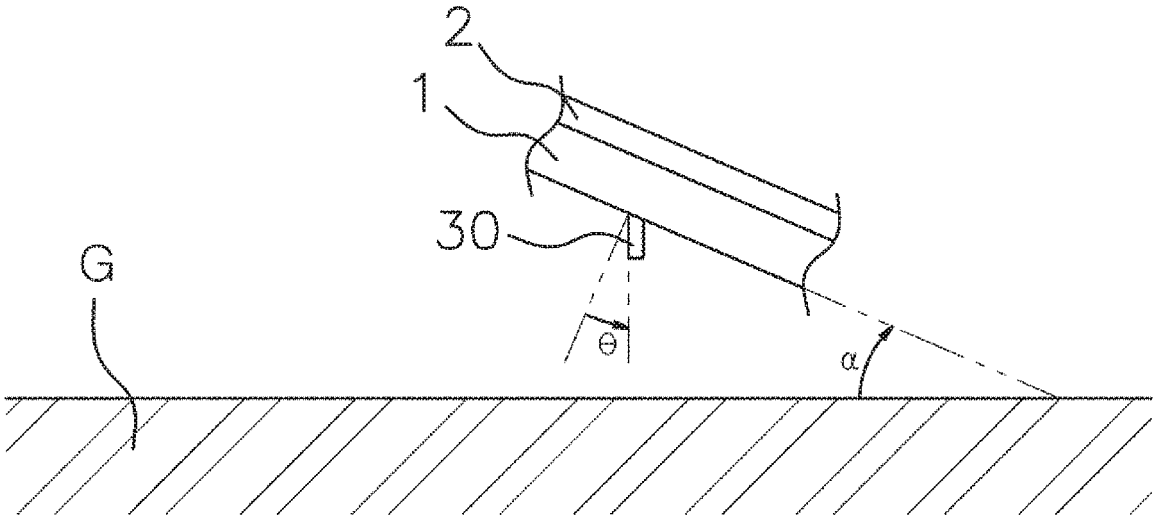
FIG. 5 is a view schematically illustrating operation of the shoe of the present invention.

Considering the general walking process in the state in which the wearer puts on the shoes, the bottom surface of the outsole 1 does not come into contact with the ground G in a parallel relation, as illustrated in FIG. 5, but the bottom surface of the outsole 1 comes into contact with the ground G at a certain angle α. Specifically, after the bottom surface of the posterior portion of the outsole 1 first comes into contact with the ground, the bottom surface of the anterior portion of the outsole 1 comes into contact with the ground.

Therefore, if the movable member 30 is perpendicular to the bottom surface of the outsole 1, as illustrated in FIG. 2, the movable member 30 comes into contact with the ground at deviations higher than a certain angle during walking this instance, the lower end of the movable member 30 is inclined to the ground at a certain angle, so that the movable member 30 may not be stably supported by the icy road or the like.

Figure 3:
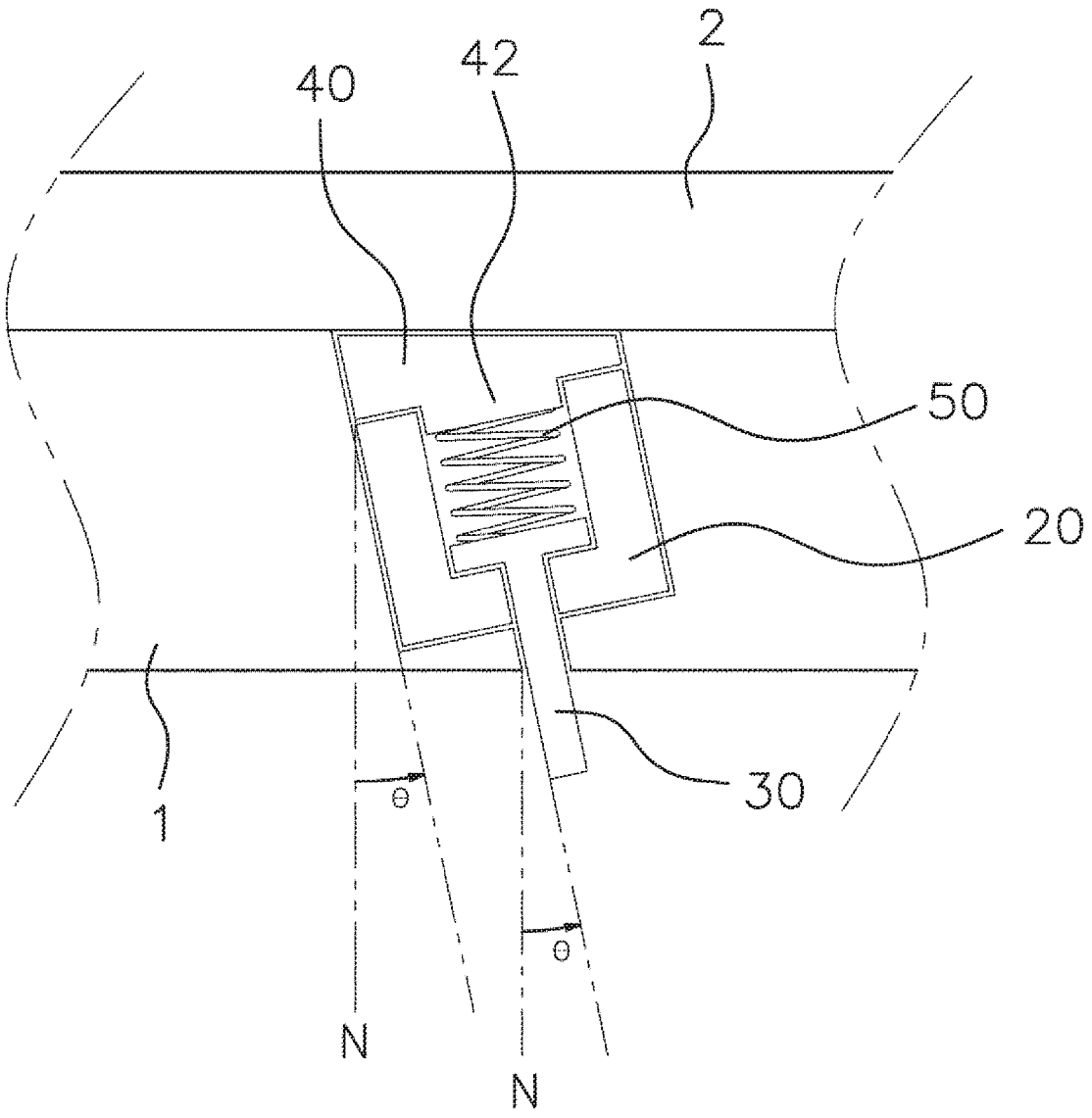
FIG. 3 is a cross-sectional view schematically illustrating a shoe according to another embodiment of the present invention.

In order to solve the above problem, as illustrated in FIG. 3, the present invention proposes that the groove portion 12 and the penetrated portion 16 of the accommodation groove 10 are formed to be inclined by a predetermined angle θ to a normal line N of the bottom surface of the outsole 1 in a counterclockwise direction. It is preferable that the angle θ is set in view of a common angle between a heel of the posterior portion of the outsole 1 and the ground, as illustrated in FIG. 5, when the wearer's shoe comes into contact with the ground.

If the groove portion 12 and the penetrated portion 16 of the accommodation groove 10 are formed to be inclined by a predetermined angle θ to a normal line N of the bottom surface of the outsole 1 in the counterclockwise direction, the support member 20 is accommodated in the groove portion 12 of the accommodation groove 10 in the state in which the support member 20 is inclined by the predetermined angle θ to the normal line N of the bottom surface of the outsole 1 in the counterclockwise direction, and the movable member 30 is inserted into the second guide portion 26 and the penetrated portion 16 in the state in which it is inclined by the predetermined angle θ to the normal line N of the bottom surface of the outsole 1 in the counterclockwise direction.

In this instance, when the outsole 1 comes into contact with the ground G during walking shown in FIG. 5, the movable member 30 exposed through the bottom surface of the outsole 1 at a certain length can minimize angle variations to the ground G. Thus, the impact generated when the outsole 1 comes into contact with the ground can be more completely absorbed by the resilient member 50, and the lower end of the movable member 30 gets stuck in the ground in the very stable state to prevent the shoe from being slid.

The top surface of the pressing member 40 may be formed to be inclined at a predetermined angle, as illustrated in FIG. 3. In this instance, even though the bottom surface of the midsole 2 is not provided with a separate groove, the midsole 2 can be sassily engaged to the top surface of the outsole 1.

Meanwhile, if the support member 20 is accommodated in the groove portion 12 of the accommodation groove 10 in the state in which it is inclined by the predetermined angle θ to the normal line N of the bottom surface of the outsole 1 in the counterclockwise direction, and the movable member 30 is inserted into the second guide portion 26 and the penetrated portion 16 in the state in which it is inclined by the predetermined angle θ to the normal line N of the bottom surface of the outsole 1 in the counterclockwise direction, the shape of the groove portion 12 may be deformed due to variations in thick of the bottom surface of the groove portion 12.

Figure 4:
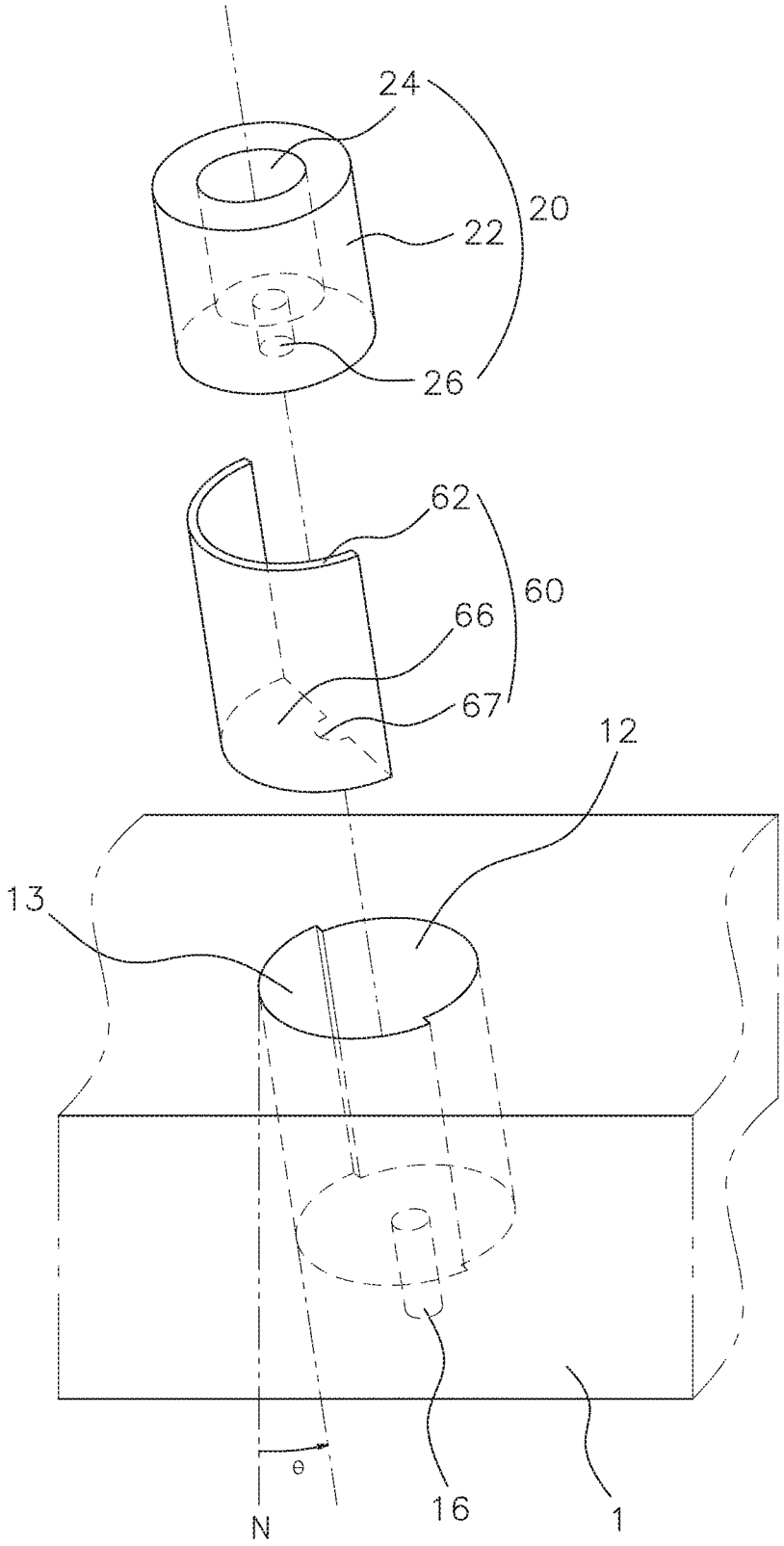
FIG. 4 is a perspective view schematically illustrating a shoe according to another embodiment of the present invention.

In order to solve the above problem, as illustrated in FIG. 4, the present invention proposes that a semi-cylindrical seating groove 13 is formed on a front portion of the accommodation groove 10, and an auxiliary support member 60 is interposed between the accommodation groove 10 and the support member 20. The auxiliary support member 60 is means for supporting a stable shape of the groove portion 12, and is provided with a lateral wall 62 and a bottom plate 66.

The lateral wall 62 is formed of a semi-cylindrical structure, and the bottom plate 66 is formed of a semi-circular plate, and is provided at a lower portion of the lateral wall 62. If the auxiliary support member 60 is disposed at a front thinnest portion of the bottom surface of the groove portion 12, even though the front portion of the support member 20 frequently presses the front portion of the groove portion 12 due to the load generated when the outsole 1 comes into contact with the ground, the shape of the groove 12 can be stably maintained for a long time. Reference numeral 67 indicates a semi-circular groove for the protruding portion 36.

Alternatively, the lower end of the protruding portion 36 of the movable member 30 may be provided with a contact end 37. It is preferable that the contact end 37 is formed with a recessed portion at a center, as illustrated in FIG. 2.

Since the icy road is relatively harder than ice, the movable member 30 can be easily slid if it does not come into strongly contact with the surface of the icy road. In this instance, if the lower end of the protruding portion 36 is formed with the recessed portion, such as the contact end 37, when the lower end of the protruding portion 36 comes into contact with the icy road, an edge of the recessed portion can strongly press the surface of the icy road, thereby remarkably reducing the sliding phenomenon.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

The invention claimed is:

1. A non-skid shoe capable of absorbing shock comprising:

an outsole (1) having a predetermined thickness;

a plurality of accommodation grooves (10) which are provided at an anterior portion and a posterior portion of the outsole (1), and respectively include a groove portion (12) having a cylindrical structure of a predetermined depth, of which an upper portion is opened toward a top surface of the outsole (1), and a penetrated portion (16) having an upper end communicating with a center of a bottom surface of the groove portion (12) and a lower end penetrating a bottom surface of the outsole (1);

a support member (20) which is accommodated in the respective accommodation grooves (10), and includes a support portion (22) having a cylindrical shape of a predetermined height and disposed in the groove portion (12), a first guide portion (24) formed at a center of the support portion (22) to have a predetermined depth, an upper portion of the first guide portion (24) being opened, and a second guide portion (26) communicating with a center of a bottom surface of the first guide portion (24), a lower end penetrating a bottom surface of the center of the support portion (22), in which the second guide portion (26) is disposed coaxially with the penetrated portion (16);

a movable member (30) which is disposed in the respective support members (20), and includes a latch portion (32) latched onto a lower portion of the first guide portion (24), and a protruding portion (36) having an upper end engaged to a bottom surface of the latch portion (32), and a lower extended portion penetrating the second guide portion (26) and the penetrated portion (16) in order and exposed through the bottom surface of the outsole (1);

a pressing member (40) which is engaged to the upper portion of the first guide portion (24) to seal the upper portion;

a resilient member (50) which is disposed in the first guide portion (24), of which an upper end comes into contact with a bottom surface of the pressing member (40), and a lower end comes into contact with a top surface of the latch portion (32) of the movable member (30); and a midsole (2) of a predetermined thickness which is engaged to the top surface of the outsole (1) so that the pressing member (40) comes into integrally contact with an upper portion of the support member (20), wherein:

the groove portion (12) and the penetrated portion (16) of the accommodation groove (10) are formed to be inclined by a predetermined angle θ to a normal line N of the bottom surface of the outsole (1) in a counter-clockwise direction; and an auxiliary support member (60) is interposed between the accommodation groove (10) and the support member (20); a semi-cylindrical seating groove (13) is formed on a front portion of the accommodation groove (10); the auxiliary support member (60) has a lateral wall (62) of a semi-cylindrical structure and a bottom plate (66) of a semi-circular plate structure which is provided at a lower portion of the lateral wall (62); and the auxiliary support member (60) is disposed in the seating groove (13) at a front thinnest portion of the bottom surface of the groove portion (12) relative to the bottom surface of the outsole (1).

2. The non-skid shoe capable of absorbing shock according to claim 1, wherein a lower end of the protruding portion (36) of the movable member (30) is provided with a contact end (37), and the contact end (37) is formed with a recessed portion at a center.

* * * * *